US007544104B2

(12) United States Patent
Fan et al.

(10) Patent No.: US 7,544,104 B2
(45) Date of Patent: Jun. 9, 2009

(54) ELECTRICAL INTERCONNECTION WITH TERMINALS IN COLUMNS

(75) Inventors: Chia-Wei Fan, Tu-Cheng (TW); Hao-Yun Ma, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 90 days.

(21) Appl. No.: 11/786,228

(22) Filed: Apr. 11, 2007

(65) Prior Publication Data

US 2008/0160839 A1 Jul. 3, 2008

(51) Int. Cl.
*H01R 9/22* (2006.01)

(52) U.S. Cl. ..... 439/722; 439/65; 439/74

(58) Field of Classification Search ..... 439/722, 439/65, 78, 74, 660, 83, 862; D13/120
See application file for complete search history.

(56) References Cited

U.S. PATENT DOCUMENTS 5,269,694 A * 12/1993 Kachlic et al. ..... 439/79
5,356,299 A * 10/1994 Kunishi et al. ..... 439/83
5,433,616 A * 7/1995 Walden ..... 439/62
5,641,290 A * 6/1997 Yagi ..... 439/74
6,048,482 A * 4/2000 Lemke et al. ..... 264/251
7,413,476 B2 * 8/2008 Ma ..... 439/637

* cited by examiner

*Primary Examiner*—Briggitte R Hammond
*Assistant Examiner*—Vanessa Girardi
(74) *Attorney, Agent, or Firm*—Wei Te Chung

(57) ABSTRACT

An electrical interconnection includes a plug connector (30) and a receptacle connector (40) mated with each other, with uniformly-spaced mounting portions (3053, 4053) for engaging contacts of two parallel spaced circuit boards. The uniformly-spaced mounting portions are achieved by providing neck portions (3057, 4057), attached to the mounting portions, angled with different degrees with respect to respective planes of base portions (3051, 4051) of terminals (305, 405) in the plug connector and the receptacle connector.

11 Claims, 4 Drawing Sheets

ELECTRICAL INTERCONNECTION WITH TERMINALS IN COLUMNS

BACKGROUND OF THE INVENTION

1. Field of the Invention

The present invention relates to the art of electrical connectors, and more particularly to an electrical interconnection including a pair of mated connectors placed between two parallel circuit boards.

2. Description of Related Art

An electrical interconnection including a pair of mated connectors is placed between two parallel circuit boards for establishing electrical continuity between the two circuit boards. In generally, one of the mated connectors includes a plurality of contact terminals 10 arranged in a series of adjacent columns, with mating portions 103 structurally different from mating sections 203 of deflectable terminals 20 of the other connector and adapted for electrically mating with the respective mating sections 203. FIG. 4 is a sketch view showing one configuration of contact terminals between mated connectors. The contact terminals 10 and 20 of the mated connectors are disposed in an opposed relationship such that a total mating force created by mating one connector contact terminals 10 with the other connector deflectable terminals 20 is substantially equal to zero. This may be result in different distances between every two adjacent mounting portions 101 of one connector arranged opposite to the mating portions 103, or of the two mated connector. For instance, in FIG. 4, the distance between the two mounting portions 101 of one connector may be a distance designated as "A", while the distance between the two mounting sections 201 of another mated connector may be a distance designated as "B" or "C", with the distances "A", "B" and "C" being not equal with each other. In most applications, it is desirable that the distance "A" between every two adjacent mounting portions 101 of one connector, or the distance "A", "B" and "C" should be equal in order to be mountable to the two parallel circuit boards having contacts spaced in a same distance therebetween, the spaced contacts being in correspondence with and engageable with the mounting portions 101 and/or mounting sections 201 of the mated connectors.

SUMMARY OF THE INVENTION

Uniformly-spaced mounting portions are achieved by providing neck portions, attached to the mounting portions, angled with different degrees with respect to respective planes of base portions of terminals in a first connector and/or a second connector of an electrical interconnection.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
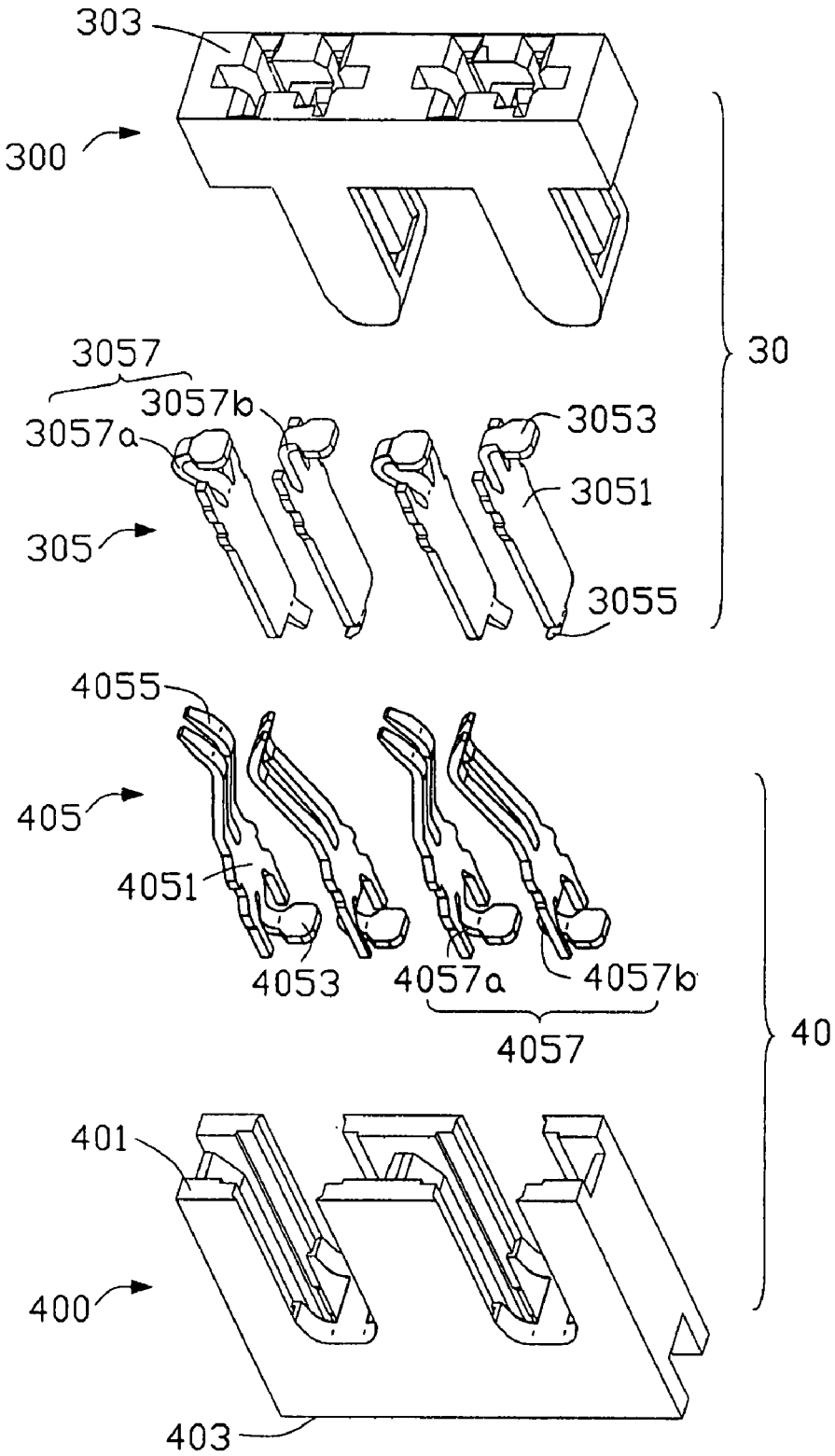
FIG. 1 is an exploded, perspective view of a part of an electrical interconnection according to an embodiment of the present invention.
Figure 2:
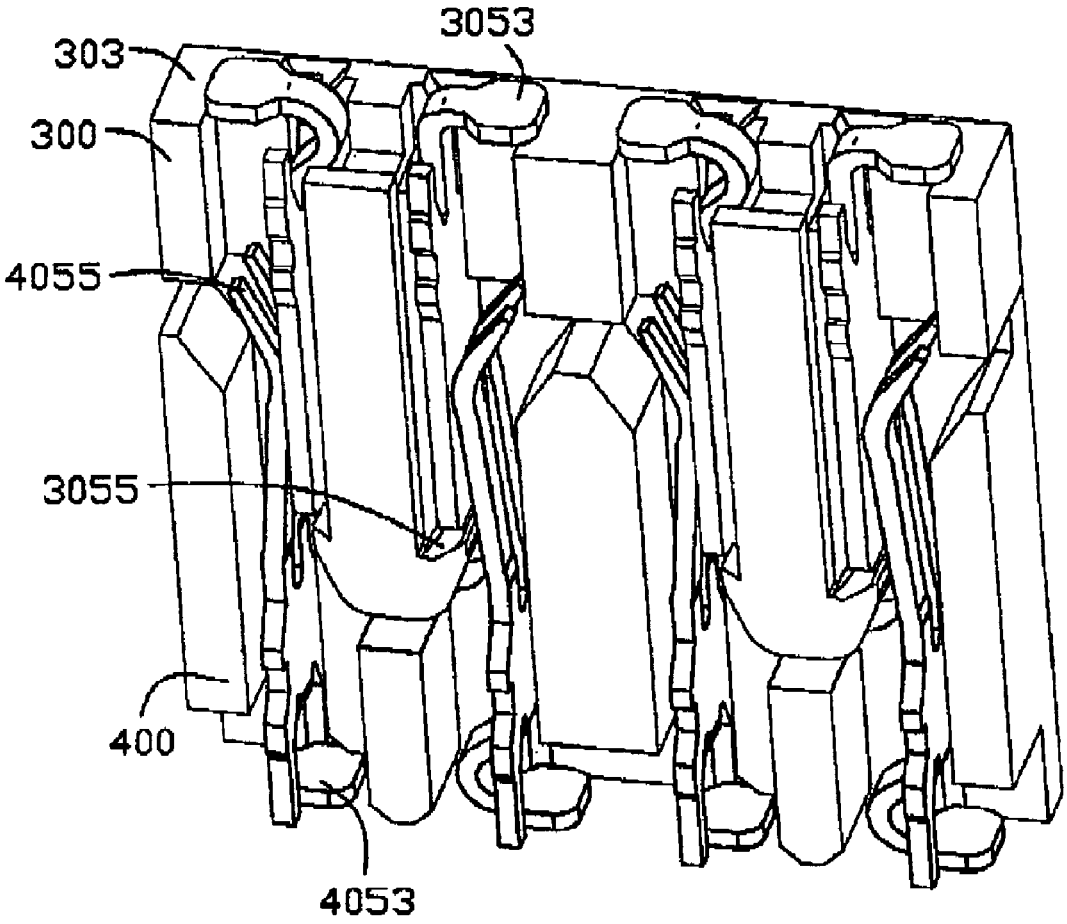
FIG. 2 is an assembled, perspective view of the electrical interconnection of FIG. 1, showing arrangement of terminals within the electrical interconnection.
Figure 3:
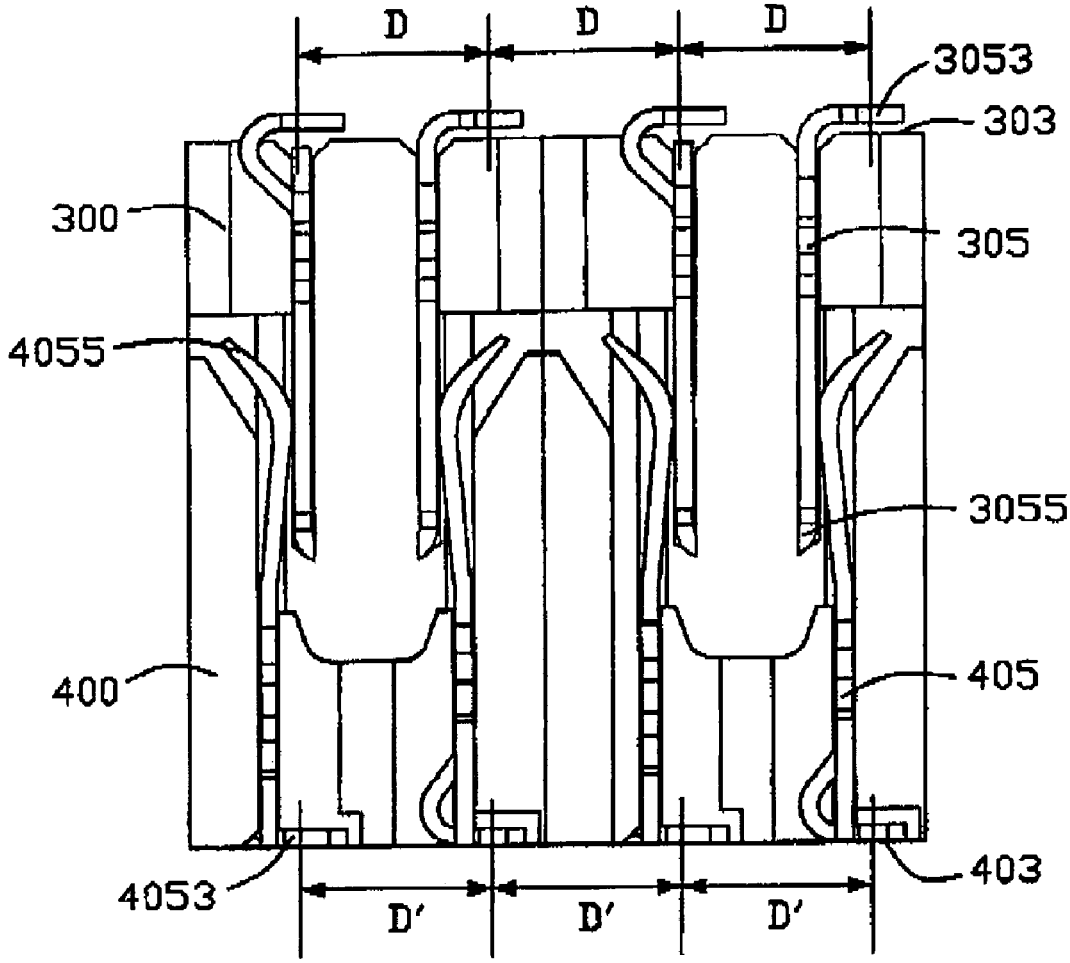
FIG. 3 is a front, plan view of the electrical interconnection of FIG. 2.
Figure 4:
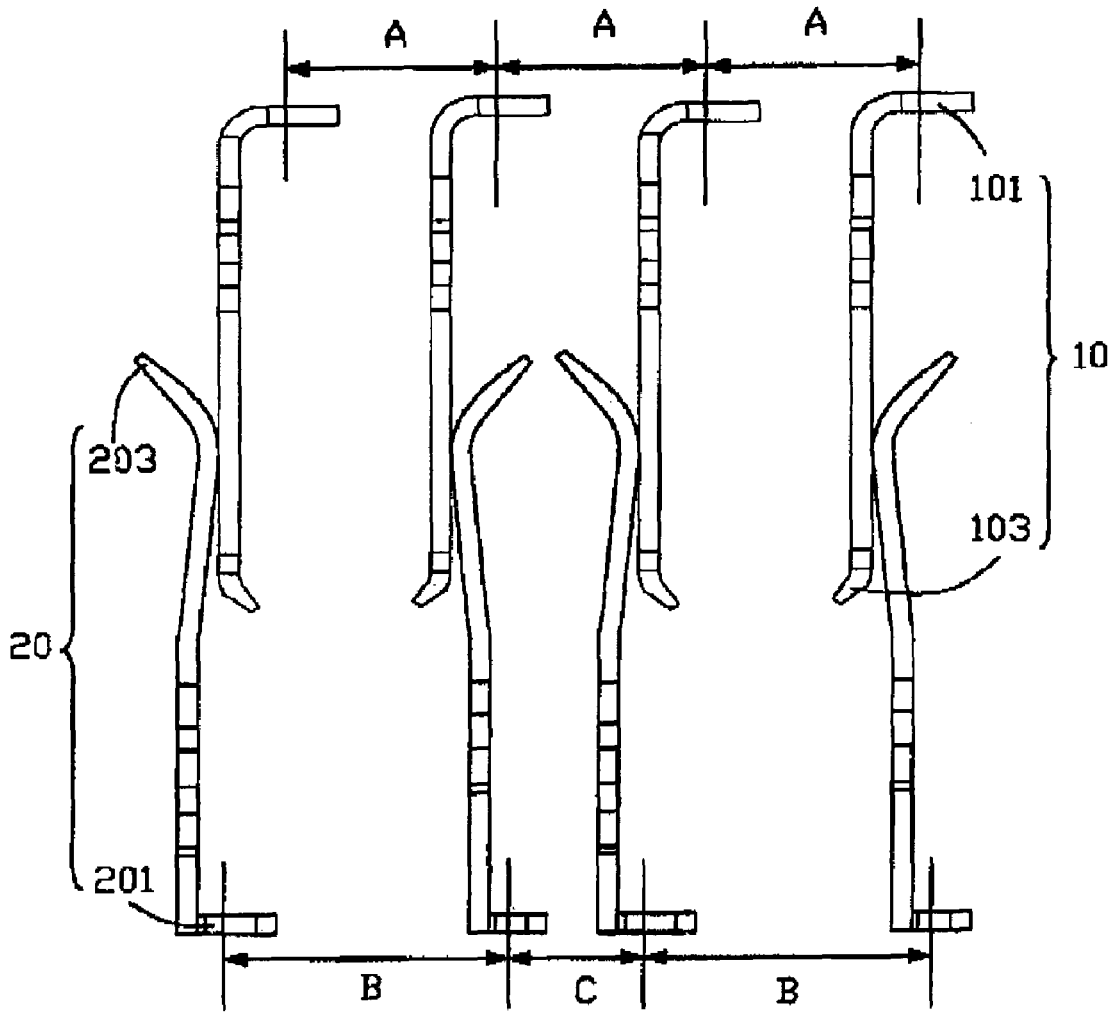
FIG. 4 (PRIOR ART)
FIG. 4 is a sketch view showing arrangement of terminals in a conventional electrical interconnection.

Referring to FIGS. 1 to 3, an embodiment of an electrical interconnection is shown for establishing electrical continuity between two parallel circuit boards (not shown). The electrical interconnection includes a pair of mated connectors including a plug connector 30 and a receptacle connector 40. The receptacle connector 40 includes a connector body 400 having a base with a mating interface 401 and an opposite mounting interface 403. A plurality of deflectable contact terminals 405 is arranged in a series of adjacent columns, with each having a base portion 4051 residing in a plane and adapted to be secured in the connector body 400. The deflectable terminal 405 of the receptacle connector 40 further includes a mounting portion 4053 located adjacent the mounting interface 403 of the connector body 400 for engaging a contact of one of the parallel circuit boards, with a neck portion 4057 attached to the mounting portion 4053 and angled with respect to the plane of the base portion 4051 of the terminal 405 of the receptacle connector 40. A mating portion 4055 of each deflectable terminal 405 is arranged opposite to the mounting portion 4053 for electrically mating with a mating section 3055 of a respective terminal 305 of the plug connector 30 (to be later described).

The plug connector 30 includes a body 300 for mating with the receptacle connector 40 at the mating interface 401, and has a base with a mounting face 303 for facing another circuit board. A plurality of contact terminals 305 is arranged in correspondence with the respective deflectable terminals 405 of the receptacle connector 40 for electrically mating with the receptacle connector deflectable terminals 405. Each of the contact terminals 305 has a base section 3051 residing in a plane and adapted to be secured in the body 300 of the plug connector 30. The contact terminal 305 further includes a mounting section 3053 located adjacent the mounting face 303 of the plug connector 30 and adapted for engaging a conductive terminal of the another circuit board, with a neck section 3057 attached to the mounting section 3053 and angled with respect to the plane of the base section 3051 of the contact terminal 305 of the plug connector 30. The mating section 3055 of each terminal 305 of the plug connector 30 is arranged opposite to the mounting section 3053 for electrically mating with the mating portion 4055 of the respective deflectable terminal 405 of the receptacle connector 40. In this embodiment, the terminals 405 of the receptacle connector 40 and the plug connector 30 have their mating portions 4055 and mating sections 3055 disposed in an opposed relationship such that a total mating force creating by mating the plug connector contact terminals 305 with the receptacle connector deflectable terminals 405 is substantially equal to zero.

According to the present invention, at least some of the plug connector contact terminals 305 and the receptacle connector deflectable terminals 405 have their neck sections 3057 and/or neck portions 4057 angled in different degrees with respect to the respective planes such that a distance, designated as "D", between every two adjacent mounting sections 3057 of the plug connector 30 is identical or equal, and/or a distance, designated as "D'", between every two adjacent mounting portions 4057 of the receptacle connector 40 is identical or equal. The former will result in that the distance "D" associated with the plug connector 30 is substantially equal to the distance "D'" associated with the receptacle connector 40, thereby forming uniformly-spaced mounting portions 4057 and mounting sections 3057 at the respective mounting interfaces 403 and 303 of the plug connector 40 and the receptacle connector 30 so as to be configured as the electrical interconnection applicable to the two parallel circuit boards having contact portions spaced apart in a same distance, the contact portions being in correspondence with the respective mounting portions 4053 of the receptacle connector 40 and the mounting sections 3053 of the plug connector 30.

Referring to FIG. 3, in this embodiment, the plug connector 30 includes odd columns of the terminals 305 with each of their neck sections 3057*a* angled in a first degree in a common direction with respect to the respective terminal plane 3051, and even columns of the terminals 305 having each of their neck sections 3057*b* angled in a second degree in a common direction with respect to the respective terminal plane 3051. The receptacle connector 40 includes even columns of the terminals 405 with each of their neck portions 4057*a* angled in a third degree in a common direction with respect to the respective terminal plane 4051, and odd columns of the terminals 405 having each of their neck portions 4057*b* angled in a fourth degree in a common direction with respect to the respective terminal plane 4051.

While the present invention has been described with reference to d embodiments, the description of the invention is illustrative and is e construed as limiting the invention. Various of modifications to the invention can be made to preferred embodiments by those skilled in without departing from the true spirit and scope of the invention as by the appended claims.

What is claimed is:

1. An electrical connector assembly comprising:

a first connector including:

a first insulative housing; and two juxtaposed pairs of first terminals disposed in the first housing, each of said first terminals including a first main body with a first lower horizontal soldering section, wherein the respective four first main bodies of said two pairs are essentially equally spaced from one another; wherein for each pair the first lower horizontal soldering sections extend toward a same direction while one first lower horizontal soldering section located beside the other in said direction is intentionally shifted toward the other so as to obtain an essentially equal distance between every adjacent two of the respective four fist lower horizontal soldering sections.

2. The connector assembly as claimed in claim 1, wherein a pitch between every adjacent two first main bodies is essentially equal to that between every adjacent two first lower horizontal soldering sections.

3. The connector assembly as claimed in claim 1, further including a second connector mated with the first connector, wherein said second connector includes a second insulative housing with two juxtaposed pairs of second terminals therein wherein each second terminals defines a second main body and a second lower horizontal soldering section, wherein said two pair of second terminals have a smaller internal self spacing and a lager external mutual spacing with each other, and for each pair of second terminals, the second lower horizontal soldering sections extend away from each other while one second lower horizontal soldering section is intentionally shifted toward the other so as to obtain an essentially equal distance between every adjacent two of the respective four second lower horizontal solder sections.

4. The electrical connector assembly as claimed in claim 3, wherein the distance between every adjacent two of the respective four second lower horizontal soldering sections is essentially equal to that between every adjacent two of the respective four first lower horizontal soldering sections.

5. An electrical connector comprising:

a connector body having a base with a mounting interface; and a plurality of contact terminals arranged in a series of adjacent columns, each terminal having a base portion residing in a plane and adapted to be secured in the connector body, each of the terminals having a mounting portion adjacent the mounting interface for electrically mating with a contact of an electronic component, and a neck portion attached to the mounting portion, the neck portion angled with respect to the plane of the terminal;

wherein said connector has at least some of said neck portions angled in different degrees with respect to the respective terminal plane such that a distance between every two adjacent mounting portions of said connector is substantially equal.

6. The electrical connector of claim 5, wherein the connector has at least some of their neck portions angled in a common direction with different degrees with respect to the respective planes of the connector terminals.

7. The electrical connector of claim 6, wherein the connector includes odd columns of the terminals having each of their neck partions angled in a first degree with respect to the respective terminal plane, and even columns of the terminals having each of their neck portions angled in a second degree with respect to the respective terminal plane.

8. An electrical interconnection comprising:

a first connector, including:

a connector body having a base with a mating interface and an opposite mounting interface;

a plurality of contact terminals arranged in a series of adjacent columns, each terminal having a base portion residing in a plane and adapted to be secured in the connector body, each of the terminals having a mounting portion adjacent the mounting interface of the connector body for engaging a contact of an electrical member, and a neck portion attached to the mounting portion, the neck portion angled with respect to the plane of the terminal; and a second connector, including:

a body for mating with the first connector at said mating interface and having a base with a mounting face;

a plurality of deflectable contact terminals for mating with the respective contact terminals of the first connector, each deflectable contact terminal having a base section residing in a plane and adapted to be secured in the body of the second connector, the deflectable contact terminal including a mounting section adjacent the mounting face of the second connector and adapted for engaging a conductive terminal of another electrical member, with a neck section attached to the mounting section, the neck section angled with respect to the plane of the deflectable contact terminal;

wherein the first connector and the second connector have at least some of said neck portions and neck sections angled in different degrees with respect to the respective planes such that a distance between every two adjacent mounting portions of the first connector is identical, a distance between every two adjacent mounting sections of the second connector is identical, and the distance associated with the first connector mounting sections is substantially equal to that of the second connector mounting portions.

9. The electrical interconnection of claim 8, wherein said at least some of the first connector terminals have their neck portions thereof angled in a common direction with different degrees with respect to the respective planes of the first connector terminals.

10. The electrical interconnection of claim 9, wherein the first connector includes odd columns of the terminals having each of their neck portions angled in a first degree with respect to the respective terminal plane, and even columns of the terminals having each of their neck portions angled in a second degree with respect to the respective deflectable terminal plane.

11. The electrical interconnection of claim 10, wherein the second connector includes even columns of the terminals having each of their neck sections angled in a third degree with respect to the respective terminal plane, and odd columns of the terminals having each of their neck sections angled in a fourth degree with respect to the respective deflectable terminal plane.

* * * * *